US005951268A

United States Patent [19]

Pottier et al.

[11] Patent Number: 5,951,268

[45] Date of Patent: Sep. 14, 1999

[54] SPERIAL VACUUM PUMP HAVING A METAL BELLOWS FOR LIMITING CIRCULAR TRANSLATION MOVEMENT

[75] Inventors: Daniel Pottier, Le Chateau D'Olonne; Rémy Leclaire, Corneville Sur Risle, both of France

[73] Assignee: S.B.P.V. (Societe des Brevets P. Vulliez), Pont Audemer, France

[21] Appl. No.: 08/894,638

[22] PCT Filed: Feb. 23, 1996

[86] PCT No.: PCT/FR96/00289

§ 371 Date: Aug. 25, 1997

§ 102(e) Date: Aug. 25, 1997

[87] PCT Pub. No.: WO96/26366

PCT Pub. Date: Aug. 29, 1996

[30] Foreign Application Priority Data

Feb. 24, 1995 [FR] France ..... 95 02209

[51] Int. Cl.[6] ..... F04C 18/04

[52] U.S. Cl. ..... 418/5; 418/55.2; 418/55.3; 418/55.5; 418/56; 418/57; 418/60; 464/102

[58] Field of Search ..... 418/5, 55.2, 55.3, 418/55.5, 56, 57, 60; 464/102

[56] References Cited

U.S. PATENT DOCUMENTS

| | | | |
|---|---|---|---|
| 3,782,865 | 1/1974 | Braun | 418/56 |
| 3,817,664 | 6/1974 | Bennett et al. | 418/57 |
| 4,477,238 | 10/1984 | Terauchi | 418/55.2 |
| 4,650,405 | 3/1987 | Iwanami et al. | 418/5 |

FOREIGN PATENT DOCUMENTS

| | | | |
|---|---|---|---|
| 0 529 660 | 3/1993 | European Pat. Off. . | |
| 1596943 | 7/1970 | France . | |
| 2 300 238 | 9/1976 | France . | |
| 1262391 | 10/1989 | Japan | 418/55.3 |

*Primary Examiner*—John J. Vrablik
*Attorney, Agent, or Firm*—Young & Thompson

[57] ABSTRACT

A vacuum pump with circular translation cycle comprises a stationary body (10) with a stationary disc (13, 14) that includes, at least on one side thereof, a spiral-shaped projection (23, 24, 25), a movable disc (30) facing the stationary one (13, 14) and also including at least one spiral-shaped projection (33, 34, 35) interleaved with the projection (23, 24, 25) of the stationary disc (13, 14) and with the same angular range, a mechanism connecting the movable disc (30) to the body (10) so that it is supported thereby and controlling the circular translational motion of the movable disc (30) in relation to the body (10), and actuating unit (20) for driving the movable disc (30) by a pump shaft (50) that is centrally located in relation to the stationary body (10), the mechanism comprising at least one bearing (47) supported by the pump shaft (50) . The pump also includes a device for limiting undesirable travel in the circular translation of the disc, the device being a metallic bellows (60).

11 Claims, 1 Drawing Sheet

II
II

SPERIAL VACUUM PUMP HAVING A METAL BELLOWS FOR LIMITING CIRCULAR TRANSLATION MOVEMENT

The present invention concerns a vacuum pump with circular translation cycle.

To be more precise, it concerns a vacuum pump with circular translation cycle comprising a stationary body with a stationary disk that includes, at least on one side thereof, a spiral-shaped projection, a movable disk facing the stationary disk and also including at least one spiralshaped projection interleaved with the spiral-shaped projection of the stationary disk and with the same angular range, a mechanism by which the movable disk is connected to said body and supported by it, for driving circular translational motion of the movable disk relative to said body during operation of the pump, actuating means for driving the movable disk by means of a pump shaft so that it effects said circular translation movement, said pump also comprising a device for limiting relative circular translation movement guiding the movable disk in its circular translation movement and avoiding any torsion.

BACKGROUND OF THE INVENTION

A pump of this kind is described in FR-A-2 141 402, for example. Although a pump of this kind as described in the aforementioned document gives excellent results, it nevertheless has the drawback of comprising many components and of being bulky, especially in the radial direction, in particular because said mechanism is made up of three cranks coupled and synchronized together and disposed at the periphery of the pump, these cranks themselves assuring limitation of the relative circular translation movement.

An aim of the present invention is to provide a pump of the above type that does not have these drawbacks.

SUMMARY OF THE INVENTION

Accordingly, in accordance with the invention, a vacuum pump with circular translation cycle comprising a stationary body with at least one stationary disk that includes, on one side thereof, a spiral-shaped projection, a movable disk facing the stationary disk and also including at least one spiral-shaped projection interleaved with the spiral-shaped projection of the stationary disk and with the same angular range, a mechanism connecting the movable disk to said body and supported by it, for driving circular translational motion of the movable disk relative to said body during the operation of the pump, actuating means for driving the movable disk by means of a pump shaft to cause it to effect said circular translation movement, said pump also including a device for limiting relative circular translation movement, said mechanism comprising at least one bush supported by said pump shaft, is characterized in that said pump shaft is centrally located in relation to the stationary body, said mechanism also comprises a crankshaft adapted to move with a circular translation movement and which is connected at one end to the movable disk, movement of which it drives, while its other end, close to the actuating means, is supported by said bush, and in that the device for limiting relative circular translation movement is a metal bellows, one end of the metal bellows being attached to the stationary body and the other end of the metal bellows being attached to the crankshaft, the metal bellows surrounding the crankshaft.

Experience has shown that a bellows of the above kind is capable of assuring the relative movement limitation (antitorsion) function when the pump is rated to generate volumes at most equal to 25 $m^3$/hour, without problems, in particular without fatigue; note also that a bellows of the above kind assures total isolation of the pump enclosure, in which the vacuum is formed, from the outside and from the remainder of the pump, which increases the number of possible applications of a pump of the above kind. A pump of the above kind is therefore a so-called dry pump the active parts of which are isolated from the exterior and free of any lubricant, oil or grease. A pump of the above kind is obviously of great simplicity, compact overall size and, consequently, low cost.

Advantageously, the pump comprises a movable disk constituted of two movable plates the spiral-shaped projections of which are on opposite faces of the movable plates, the movable disk being disposed between a stationary annular disk and a flange the facing faces of which carry the stationary spiral-shaped projections.

Advantageously, the flange has a peripheral spiralshaped projection extended towards the axis of the pump along a central spiral-shaped projection the axial height of which is less than that of the peripheral projection, the peripheral projection and the central projection having their free ends in a common transverse plane, one of the movable plates opposite the flange being provided, on the one hand, with a spiral-shaped projection interleaved with the peripheral projection of the flange and with the same angular range and, on the other hand, a spiral-shaped projection interleaved with the central projection of the flange and with the same angular range.

Preferably, the two plates of the mobile disk are connected by a U-section annular ring the walls of which have a thickness enabling the two plates to move axially relative to each other; a spring between the two plates urges them axially away from each other.

Advantageously, the plates, their projections and the annular ring are made in one piece from a material allowing contact between the movable disk, on the one hand, and the stationary disk and the stationary flange, on the other hand, which are made of metal, this contact being with minimum friction; preferably, the spiral-shaped projections of the stationary disk and the spiral-shaped projections of the movable disk are in rubbing cooperation during operation of the pump.

Advantageously, the crankshaft has a generally frusto-conical central part the smaller base end of which carries a cylindrical sleeve with longitudinal splines on its exterior surface cooperating with complementary longitudinal splines on the interior surface of a skirt carried by the movable plate opposite the flange.

Preferably, the skirt is also made in one piece with the movable disk.

Advantageously, the pump shaft is a hollow shaft having, on the one hand, a cylindrical outside bearing surface through which it is supported by the body through the intermediary of bearing means and, on the other hand, a cylindrical bore receiving the bush with a bearing between them, the cylindrical external bearing surface being axially offset relative to the cylindrical bore, the diameter of which is greater than the diameter of the cylindrical external bearing surface.

Preferably, the metal bellows has two corrugated areas on respective opposite axial sides of a cylindrical central area.

BRIEF DESCRIPTION OF THE DRAWINGS

The features and advantages of the invention will emerge from the following description given by way of example with reference to the accompanying drawing, in which.

DETAILED DESCRIPTION OF THE INVENTION

Figures 1, 2:
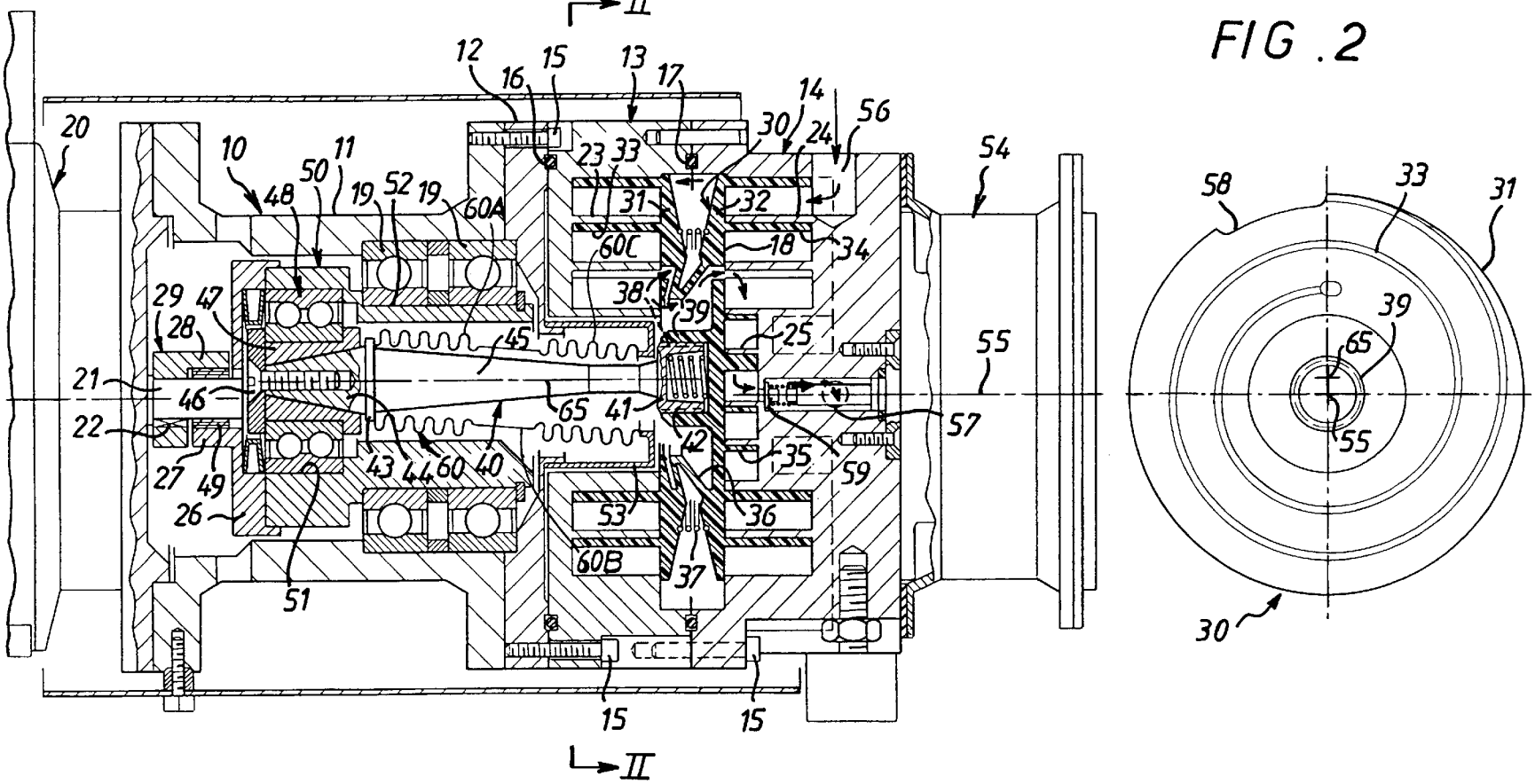
FIG. 1 is a fragmentary longitudinal sectional view of a pump in accordance with the invention.
FIG. 2 is an end view of the double movable plate in isolation as seen on the line II—II in FIG. 1.

Referring to FIGS. 1 and 2, a vacuum pump with circular translation cycle comprises a stationary body 10 which, in the example shown, is assembled from four components 11 through 14, namely a sleeve 11, an intermediate plate 12, an annular stationary disk 13 and a flange 14, disposed in succession in this order along the axial direction. The components are assembled together by circumferentially distributed screws, e.g. the screws 15; annular seals 16 and 17 are disposed between the intermediate plate 12 and the annular disk 13, on the one hand, and between the annular disk 13 and the flange 14, on the other hand, respectively.

The stationary annular disk 13 has a spiral-shaped projection 23 on the side facing the flange 14; the flange 14 has a peripheral spiral-shaped projection 24 on the side facing the annular disk 13, extending towards the axis of the pump along a central spiral-shaped projection 25 the axial height of which is less than the peripheral projection 24, the peripheral and central projections 24 and 25 having their free ends in a common transverse plane 18.

A movable disk 30 is placed between the stationary annular disk 13 and the flange 14 which is also stationary; the movable disk 30 includes a first plate 31 opposite the stationary disk 13 and provided with a spiral-shaped projection 33 interleaved with the projection 23 on the stationary disk 13 and with the same angular range; the movable disk 30 also includes a second plate 32 facing the flange 14 and provided with a spiral-shaped projection 34 interleaved with the projection 24 on the flange 14 and with the same angular range and with a spiral-shaped projection 35 interleaved with the projection 25 on the flange 14 and with the same angular range.

The two plates 31, 32 are connected by an annular ring 36 having a U-shaped cross-section open outwardly relative to the axis of the pump; the thickness of the U-shaped section of the walls of the annular ring 36 is relatively small with the result that the plates 31, 32 can move axially relative to each other; a coil spring 37 between the plates 31, 32 urges them away from each other in the axial direction.

The plates 31, 32 and their spiral-shaped projections 33, 34, 35 together with the annular ring 36 are molded and/or machined in one piece from a material allowing contact between the movable disk 30, on the one hand, and the stationary disk 13 and flange 14, on the other hand, which are of metal, such as stainless steel or aluminum alloy, this contact being with minimum friction; one example of a material of the above kind is that sold under the trade name VESCONITE by MARLIN INTERNATIONAL; this material is based on polyethylene terephthalate and contains a silicone fluid and molybdenum disulfide to minimize friction against a metal part; an equivalent material other than the above kind can naturally be used for the movable disk 30; it is likewise possible to make all the parts in contact of metal and to coat at least one of them, the movable part, for example, with a thin layer, for example a few microns, of a suitable resin such as the fluorine resin sold under the trade name FLUORIMID 10P by FLUOROTECHNIQUE. By virtue of these provisions, the efficiency of the pump is high for its size.

A mechanism is provided to couple the movable disk 30 to the stationary body 10 and to support it; this mechanism includes a crankshaft 40 having a generally frustoconical central part 45 carrying at the smaller base end a cylindrical sleeve 41 having longitudinal splines 42 on its outside surface cooperating with complementary longitudinal splines 38 on the inside surface of a skirt 39 carried by the second plate 32; the skirt 39 is also made in one piece with the mobile disk 30; at its other end, the frustoconical central part 45 of the crankshaft 40 has a flange 43 of greater diameter than the larger base of the central part 45; the flange 43 is extended by a frustoconical end 44 in which the cone angle is the opposite of that of the central part 45; this frustoconical end 44 is attached by a screw 46 to a bush 47 supporting a bearing 48 supported internally and externally by being inserted in the cylindrical bore 51 of a central drive shaft of the pump, in this example a hollow shaft 50 centered on the axis 55 of the pump; the bush 47 is centered on an axis 65 offset from the axis 55 and constitutes a crank to which the crankshaft 40 is attached; the hollow shaft 50 has a cylindrical external bearing surface 52; bearing means 19 are disposed between the cylindrical outside bearing surface 52 of the hollow shaft 50 and an internal cylindrical bore of the sleeve 11 to support the hollow shaft 50 relative to the body 10. The cylindrical outside bearing surface 52 is axially offset relative to the cylindrical bore 51, the diameter of which is greater than the diameter of the cylindrical outside bearing surface 52; by virtue of this feature, in combination with that whereby the crank constituted by the bush 47 is axially offset from the stationary disk 13 and the movable disk 30, the pump advantageously has a compact overall size in the radial direction.

The hollow shaft 50 is attached to a drive flange 26 having fingers 27 circumferentially interleaved with fingers 28 of a nut 29 fastened by means of a key 22 to the drive shaft 21 of a motor 20, part of which is shown in FIG. 1.

In accordance with the invention, the central part 45 of the crankshaft 40 is surrounded by a metal bellows 60; the metal bellows 60 advantageously has two corrugated areas 60A, 60C on respective opposite axial sides of a cylindrical central area 60B; one end is fixed to the flange 43 of the crankshaft 40; the other end of the bellows 60 is fixed to the end of a bell 53 attached to the intermediate plate 12 of the body 10, as close as possible to the skirt 39 of the second plate 32 of the movable disk 30, with the result that the bellows 60 is of great length: by virtue of this feature, the flexion angle of the bellows 60 in operation is small, which limits fatigue in the corrugated areas 60A, 60C of the bellows 60; the metal bellows 60 achieves good guidance of the movable disk 30 in its circular translation movement by preventing the shaft 40 rotating on itself, i.e. by preventing any unwanted torsion effect.

The drive shaft 21 of the motor 20 is centered on the axis 55 of the pump; the axis 65 of the bush 47, which is also the axis of the crankshaft 40, is eccentric relative to the axis 55 of the pump.

FIG. 1 shows the inlet 56 of the pump and its outlet 57 on the downstream side of a check valve 59; the variable end chambers formed by the spiral-shaped projections communicate with each other by means of lateral recesses provided in the plates 31 and 32, e.g. the recess 58 of the plate 31 shown in FIG. 2; note that the inlet 56 and the outlet 57 are disposed radially and at 900 to each other. As soon as the pump starts, the pumped gas is subjected to the continuous and progressive effect of pressure due to circular translation movement of the movable spiral-shaped projections relative to the stationary spiral-shaped projections.

As can be seen, the pump enclosure in which the vacuum is generated is completely isolated from the exterior and from the remainder of the pump by the bellows 60; a ventilator unit 54 cools the transverse exterior face of the flange 14 which is made relatively massive to absorb the heat generated by the pump and transmit it to the cooling air.

The simplicity of a pump of the above kind is evident and the pump is suitable for generating volumes equal to 25 $m^3$/hour at most. Of course, if the smallest possible overall radial dimension is not an imperative requirement, larger volumes can be generated by surrounding the metal bellows 60 with a second metal bellows fixed at its ends to the same components as those to which those of the bellows 60 are fixed.

The final stage of the pump, constituted by the small-size projections 25 and 35, procures a fluid pressure at the outlet that is virtually equal to atmospheric pressure.

We claim:

1. Vacuum pump with circular translation cycle comprising a stationary body (10) with at least one stationary disk (13-14) that includes, on one side thereof, a spiral-shaped projection (23-24-25), a movable disk (30) facing the stationary disk (13-14) and also including at least one spiral-shaped projection (33-34-35) interleaved with the spiral-shaped projection (23-24-25) of the stationary disk (13-14) and with the same angular range, a mechanism connecting the movable disk (30) to said body (10) and supported by it, for driving circular translational motion of the movable disk (30) relative to said body (10) during the operation of the pump, actuating means (20) for driving the movable disk (30) by means of a pump shaft (50) to cause it to effect said circular translation movement, said pump also including a device for limiting relative circular translation movement, said mechanism comprising at least one bush (47) supported by said pump shaft (50), wherein said pump shaft (50) is centrally located in relation to the stationary body (10), said mechanism also comprising a crankshaft (40), characterized in that said crankshaft (40) is adapted to move with a circular translation movement and which is connected at one end (41) to the movable disk (30), movement of which it drives, while its other end (44), close to the actuating means (20), is supported by said bush (47), and in that the device for limiting relative circular translation movement is a metal bellows (60), one end of the metal bellows (60) being attached to the stationary body (10) and the other end of the metal bellows (60) being attached to the crankshaft (40), the metal bellows (60) surrounding the crankshaft (40).

2. Pump according to claim 1 characterized in that the movable disk (30) is constituted of two movable plates (31, 32) the spiral-shaped projections (33, 34, 35) of which are on opposite faces of the movable plates (31, 32), the at least one stationary disk constituted by a stationary annular disk and a flange the spiral-shaped projections of which are interleaved with the spiral-shaped projections of the movable disk, the movable disk (30) being disposed between the stationary annular disk (13) and the flange (14) the facing faces of which carry the stationary spiral-shaped projections (23, 24, 25).

3. Pump according to claim 2 characterized in that the flange (14) has a peripheral spiral-shaped projection (24) extended towards the axis of the pump along a central spiral-shaped projection (25) the axial height of which is less than that of the peripheral projection (24), the peripheral projection (24) and the central projection (25) having their free ends in a common transverse plane (18), one of the movable plates (32) opposite the flange (14) being provided, on the one hand, with a spiral-shaped projection (34) interleaved with the peripheral projection (24) of the flange (14) and with the same angular range and, on the other hand, a spiral-shaped projection (35) interleaved with the central projection (25) of the flange (14) and with the same angular range.

4. Pump according to claim 2 characterized in that the two plates (31, 32) of the movable disk (30) are connected by a U-section annular ring (36) the walls of which have a thickness enabling the two plates (31, 32) to move axially relative to each other.

5. Pump according to claim 4 characterized in that a spring (37) between the two plates (31, 32) urges them axially away from each other.

6. Pump according to claim 4 characterized in that the plates (31, 32), their projections (33, 34, 35) and the annular ring (36) are made in one piece from a material allowing contact between the movable disk (30), on the one hand, and the stationary disk (13) and the stationary flange (14), on the other hand, which are made of metal, this contact being with minimum friction.

7. Pump according to claim 6 characterized in that the spiral-shaped projections (23, 24, 25) of the stationary disk (13-14) and the spiral-shaped projections (33, 34, 35) of the movable disk (30) are in rubbing cooperation during operation of the pump.

8. Pump according to claim 2 characterized in that the crankshaft (40) has a generally frustoconical central part (45) the smaller base end of which carries a cylindrical sleeve (41) with longitudinal splines (42) on its exterior surface cooperating with complementary longitudinal splines (38) on the interior surface of a skirt (39) carried by the movable plate (32) opposite the flange (14).

9. Pump according to claim 8 characterized in that the skirt (39) is also made in one piece with the movable disk (30).

10. Pump according to claim 1 characterized in that the pump shaft (50) is a hollow shaft having, on the one hand, a cylindrical outside bearing surface (52) through which it is supported by the body (10) through the intermediary of bearing means (19) and, on the other hand, a cylindrical bore (51) receiving the bush (47) with a bearing (48) between them, the cylindrical external bearing surface (52) being axially offset relative to the cylindrical bore (51), the diameter of which is greater than the diameter of the cylindrical external bearing surface (52).

11. Pump according to claim 1 characterized in that the metal bellows (60) has two corrugated areas (60A, 60C) on respective opposite axial sides of a cylindrical central area (60B).

* * * * *